US006469480B2

(12) United States Patent
Kanakubo

(10) Patent No.: US 6,469,480 B2
(45) Date of Patent: Oct. 22, 2002

(54) VOLTAGE REGULATOR CIRCUIT HAVING OUTPUT TERMINAL WITH LIMITED OVERSHOOT AND METHOD OF DRIVING THE VOLTAGE REGULATOR CIRCUIT

(75) Inventor: Yoshihide Kanakubo, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/778,238

(22) Filed: Feb. 7, 2001

(65) Prior Publication Data

US 2001/0026149 A1 Oct. 4, 2001

(30) Foreign Application Priority Data

Mar. 31, 2000 (JP) ..... 2000-98573

(51) Int. Cl.[7] ..... G05F 1/40
(52) U.S. Cl. ..... 323/269; 323/274
(58) Field of Search ..... 323/269, 272, 323/274, 284

(56) References Cited

U.S. PATENT DOCUMENTS 4,616,142 A * 10/1986 Upadhyay et al. ..... 323/272
5,025,203 A * 6/1991 Edwards ..... 323/268
5,258,653 A * 11/1993 Perry ..... 323/269
5,280,233 A * 1/1994 Poletto et al. ..... 323/274
5,528,127 A * 6/1996 Streit ..... 323/269
5,610,507 A * 3/1997 Brittan ..... 323/272
5,629,609 A * 5/1997 Nguyen et al. ..... 323/269
5,828,205 A * 10/1998 Byrne ..... 323/272
6,222,353 B1 * 4/2001 Pattamatta et al. ..... 323/269

* cited by examiner

*Primary Examiner*—Jeffrey Sterrett
(74) *Attorney, Agent, or Firm*—Adams & Wilks

(57) ABSTRACT

A voltage regulator circuit comprises a reference voltage circuit for generating a reference voltage, an error amplifying circuit for receiving the reference voltage from the reference voltage circuit and comparing the reference voltage with a given voltage resulting from dividing the output voltage of an output terminal by a pair of resistors connected in series, and an output transistor portion having two or more switchable transistors different in driving capability. A switching circuit drives a selected one of the switchable transistors in accordance with a result of the comparison by the error amplifying circuit to thereby limit overshoot of the output voltage.

10 Claims, 2 Drawing Sheets

VOLTAGE REGULATOR CIRCUIT HAVING OUTPUT TERMINAL WITH LIMITED OVERSHOOT AND METHOD OF DRIVING THE VOLTAGE REGULATOR CIRCUIT

BACKGROUND OF THE INVENTION

1. Field of the Invention

The present relates to a voltage regulator circuit capable of improving overshoot of the voltage regulator.

2. Description of the Related Art

As a conventional voltage regulator circuit, there has been known a voltage regulator shown in FIG. 4. An output voltage of a reference voltage circuit 1 and a voltage resulting from dividing a voltage of an output terminal 4 by resistors 5 and 6 are compared with each other by an error amplifying circuit 2 to thereby control an output transistor 3 on the basis of an output comparison result.

If the voltage resulting from dividing the voltage of the output terminal 4 by the resistors 5 and 6 is smaller than the output voltage of the reference voltage circuit 1, an output of the error amplifying circuit 2 becomes small and the output transistor 3 is strongly biased, thereby making the voltage of the output terminal 4 large. Conversely, if the voltage resulting from dividing the voltage of the output terminal 4 by the resistors 5 and 6 becomes larger than the output voltage of the reference voltage circuit 1, the output transistor 3 is weakly biased, thereby making the output terminal voltage small. In this manner, the voltage of the output terminal 4 is kept constant.

However, in the conventional voltage regulator, because the voltage resulting from dividing the voltage of the output terminal 4 by the resistors 5 and 6 is smaller than the output voltage of the reference voltage circuit 1 at the time of turning on a power supply, the output of the error amplifying circuit 2 becomes small and the output transistor 3 is strongly biased with the result that the voltage of the output terminal 4 is going to rapidly rise up to a given voltage. In this situation, since the voltage of the output terminal 4 rapidly rises, even if the voltage of the output terminal 4 exceeds the desired constant voltage, because a reaction of the error amplifying circuit is slow as compared with a rising speed of the voltage of the output terminal voltage 4, the voltage of the output terminal 4 is kept to the desired constant voltage a certain period of time after the output terminal voltage 4 exceeds the desired constant voltage.

As described above, because the voltage of the output terminal 4 changes more rapidly as a difference between the voltage of the output terminal 4 and the desired constant voltage to be outputted from the output terminal 4 increases, there arises such a problem in that a certain period of time elapses after the output terminal voltage 4 exceeds the desired constant voltage, resulting in that the constant output voltage cannot be outputted which is a main object of the voltage regulator.

SUMMARY OF THE INVENTION

The present invention has been made to solve the above problem with the conventional voltage regulator circuit, and therefore an object of the present invention is to reduce overshoot by causing an output terminal to rise up gently to a desired constant voltage using an output transistor low in driving capability from an error amplifying circuit of a voltage regulator when a voltage difference between an output of the output terminal and the desired constant voltage is large.

In order to achieve the above object, according to the present invention, there is provided a voltage regulator circuit in which an output transistor portion has two or more transistors different in driving capability, thereby being capable of reducing overshoot at the time of starting or when there is a large difference between a voltage of an output terminal and a desired constant voltage.

BRIEF DESCRIPTION OF THE DRAWINGS

These and other objects, features and advantages of this invention will become more fully apparent from the following detailed description taken with the accompanying drawings in which.

DETAILED DESCRIPTION OF THE PREFERRED EMBODIMENTS

Now, a description will be given in more detail of a preferred embodiment of the present invention with reference to the accompanying drawings.

Figure 1:
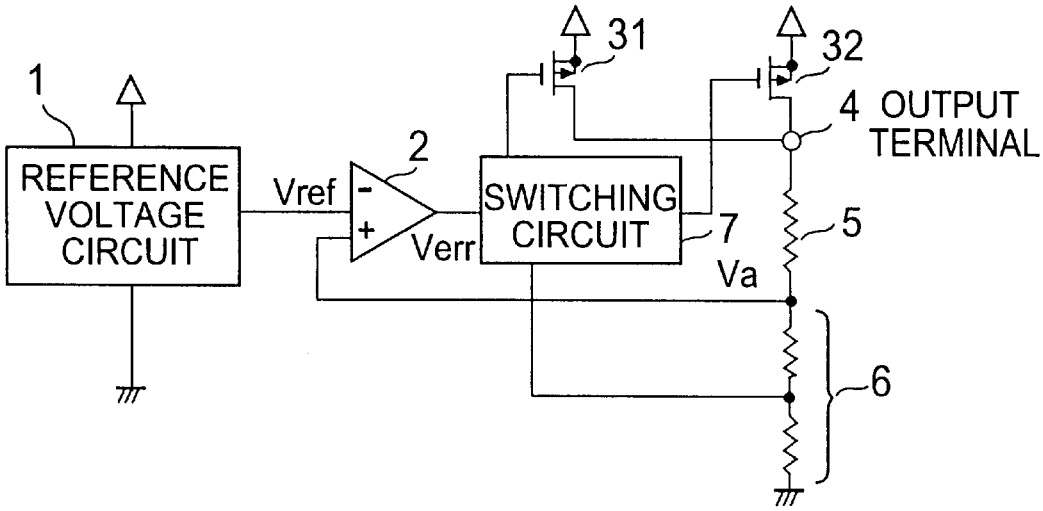
FIG. 1 is a circuit diagram showing a voltage regulator circuit in accordance with an embodiment of the present invention.

FIG. 1 is a circuit diagram showing a voltage regulator circuit in accordance with an embodiment of the present invention. A reference voltage source having a reference voltage circuit 1, an error amplifying circuit 2 and resistors 5 and 6 are identical to those in the conventional voltage regulator.

In the figure, an output of the error amplifying circuit 2 is connected to an input of a switching circuit 7, and outputs of the switching circuit 7 are connected to an output transistor 31 higher in driving capability and an output transistor 32 lower in driving capability, respectively.

Figure 2:
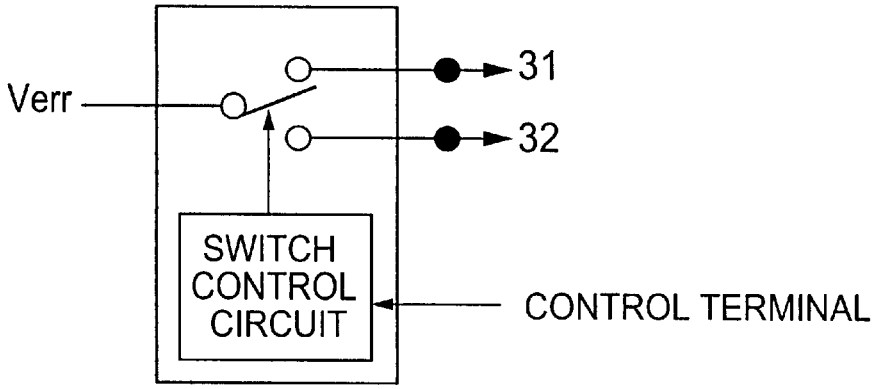
FIG. 2 is a diagram showing the outline of a switching circuit in accordance with the embodiment of the present invention.

The internal circuit of the switching circuit 7 is shown in brief in FIG. 2. The specific operation of the switching circuit 7 is that when the voltage of an output terminal 4 is lower than an arbitrary set voltage, because there is a large difference between the voltage of the output terminal 4 and a desired constant voltage to be outputted from the voltage regulator, the voltage of the output terminal 4 is made to gently rise up to the desired constant voltage by using the output transistor 32 lower in the driving capability.

Then, when the voltage of the output terminal 4 becomes higher than the arbitrary set voltage, the output transistor 31 higher in the driving capability is driven by the switching circuit 7.

As described above, since the output transistors are selectively used, even if a load slightly fluctuates during a normal operation, the output transistor 31 higher in the driving capability is driven so as to always keep the voltage of the output terminal 4 constant.

Furthermore, at the time of turning on a power supply and at the time of recovery from a load short-circuit, the output transistor 32 lower in the driving capability is used, thereby making the voltage of the output terminal 4 rise gently and thus reduce overshoot.

Figure 3:
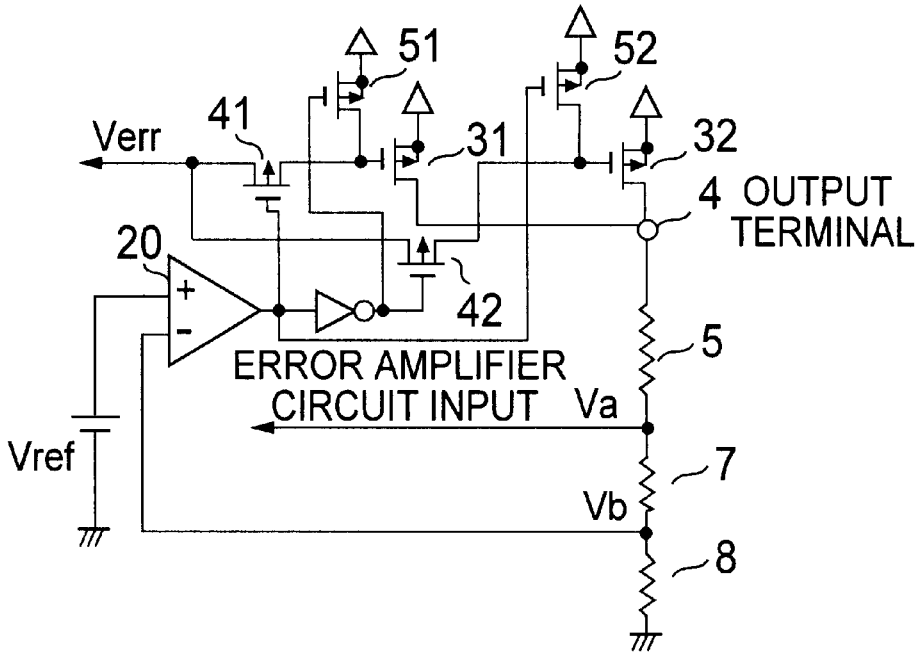
FIG. 3 is a circuit diagram showing a specific example of the switching circuit in accordance with the embodiment of the present invention.
Figure 4:
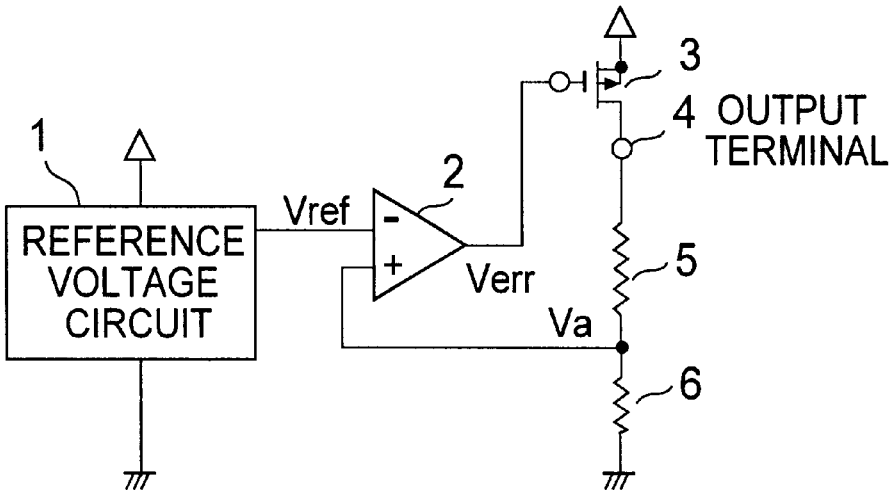
PRIOR ART FIG.4
FIG. 4 is a circuit diagram showing a conventional voltage regulator circuit.

A specific circuit example of the switching circuit 7 is shown in FIG. 3. The minus input of a comparator 20 is inputted with an output voltage Vb divided by a resistor, and the plug input of the comparator 20 is inputted with a reference voltage output Vref. If the voltage of Vb is lower than Vref, the output of the comparator 20 becomes "H", an SW Tr 42 turns on, and an output Verr of the error amplifying circuit is connected to the output transistor 32 lower in the driving capability. Also, when the voltage of Vb is higher than Vref, the output of the comparator 20 becomes "L", an SW Tr 41 turns on, and the output transistor 31 higher in the driving capability turns on. In FIG. 3, transistors 51 and 52 are transistors that conduct pull-up operation in order to prevent the gates of the transistors 31 and 32 from floating.

This embodiment is performed under the conditions where Va is inputted to the plus input of the error amplifying circuit and Vb that satisfies Va>Vb is inputted to the minus input of the comparator 20.

As described above, when the voltage Vb resulting from dividing the voltage of the output terminal 4 by the resistors 5 and 6 is lower than Vref, that is, at the time of turning on the power supply or at the time of recovery from the load short-circuit, the transistor lower in the driving capability is used, to thereby reduce the overshoot.

As was described above, according to the present invention, since two or more output transistors different in the driving capability are provided in the voltage regulator, the output is maintained to a constant voltage by using the output transistor higher in the driving capability during the normal operation even when the load fluctuates, and the overshoot can be reduced by using the output transistor lower in the driving capability at the time of starting or when there is a large difference between the output terminal and the desired constant voltage.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A voltage regulator circuit comprising:

a reference voltage circuit for generating a reference voltage;

an error amplifying circuit for receiving the reference voltage from the reference voltage circuit and comparing the reference voltage with a given voltage resulting from driving the output voltage of an output terminal by a pair of resistors connected in series;

an output transistor portion having two or more switchable transistors different in driving capability; and switching means for driving a selected one of the switchable transistors in accordance with a result of the comparison by the error amplifying circuit to thereby limit overshoot of the output voltage.

2. A voltage regulator circuit as claimed in claim 1; wherein the switchable transistors comprise a first output transistor and a second output transistor having a higher driving capability than that of the first output transistor, the first and second output transistors being connected to an output of the error amplifying circuit and disposed in parallel with the output terminal.

3. A voltage regulator circuit as claimed in claim 2; wherein the switching means includes means for driving the first output transistor when the given voltage is lower than the reference voltage and for driving the second output transistor when the given voltage is higher than the reference voltage.

4. A method of driving a voltage regulator circuit, comprising the steps of: providing a voltage regulator circuit having an output terminal, a reference voltage circuit for generating a reference voltage, a switching circuit, a first output terminal disposed in parallel with the output terminal, a second output transistor disposed in parallel with the output terminal and having a higher driving capability than that of the first output transistor, and an error amplifying circuit having an output connected to the first and second output transistors for comparing the reference voltage from the reference voltage circuit with a given voltage resulting from dividing the voltage of the output terminal by a first resistor and a second resistor connected in series; and controlling the switching circuit to drive the first output transistor when a comparison by the error amplifying circuit determines that the given voltage is lower than the reference voltage to thereby cause a gradual rise in the voltage of the output terminal.

5. A voltage regulator circuit comprising: a reference voltage circuit for generating a reference voltage; an output terminal for outputting an output voltage; an error amplifying circuit for comparing the reference voltage from the reference voltage circuit with a given voltage resulting from dividing the voltage of the output terminal by a pair of resistors connected in series; a first output terminal connected to an output of the error amplifying circuit; a second output terminal having a higher driving capability than the first output transistor and connected to the output of the error amplifying circuit; and a switching circuit for driving the first output transistor when the comparison by the error amplifying circuit determines that the given voltage is lower than the reference voltage and for driving the second output transistor when the comparison by the error amplifying circuit determines that the given voltage is higher than the reference voltage to thereby limit overshoot of the voltage of the output terminal.

6. A voltage regulator circuit according to claim 5; wherein the first and second output transistors are disposed in parallel with the output terminal.

7. A voltage regulator circuit comprising: an output terminal for connection to a load; a first output transistor; a second output transistor having a higher driving capability than that of the first output transistor; and control means for controlling the first and second output transistors to maintain an output voltage of the output terminal constant during power-up of the voltage regulator circuit or during recovery of the voltage regulator circuit from a load shortcircuit by driving the first output transistor when the output voltage of the output terminal is lower than a preselected voltage and driving the second output transistor when the output voltage of the output terminal is higher than the preselected voltage.

8. A voltage regulator circuit according to claim 7; wherein the control means comprises a switching circuit having a first output connected to the first output transistor and a second output connected to the second output transistor.

9. A voltage regulator circuit comprising:

an output terminal for connection to a load;

a reference voltage circuit for generating a reference voltage;

an error amplifying circuit for receiving the reference voltage from the reference voltage circuit and comparing the reference voltage with a given voltage resulting from dividing a voltage of the output terminal by a pair of resistors connected in series;

an output transistor portion having a first output transistor and a second output transistor having a higher driving capability than that of the first output transistor; and a switching circuit for driving the first output transistor when the given voltage is lower than the reference voltage during power-up of the voltage regulator circuit or during recovery of the voltage regulator circuit from a load shortcircuit and driving the second output transistor when the given voltage is higher than the reference voltage.

10. A voltage regulator circuit according to claim 9; wherein the first and second output transistors are disposed in parallel with the output terminal.

* * * * *